US005154883A

United States Patent [19]

Fleischer

[11] Patent Number: 5,154,883

[45] Date of Patent: Oct. 13, 1992

[54] RUTHENIUM TANTALUM INTERMETALLIC COMPOUNDS CONTAINING IRON OR COBALT

[75] Inventor: Robert L. Fleischer, Schenectady, N.Y.

[73] Assignee: General Electric Company, Schenectady, N.Y.

[21] Appl. No.: 477,793

[22] Filed: Feb. 9, 1990

[51] Int. Cl.[5] ..... C22C 29/00

[52] U.S. Cl. ..... 420/427; 429/462; 423/213.5

[58] Field of Search ..... 420/427, 462; 423/213.5

[56] References Cited

U.S. PATENT DOCUMENTS

| | | | |
|---|---|---|---|
| 3,414,439 | 12/1968 | Adlhart | 420/427 |
| 4,188,309 | 2/1980 | Voelker et al. | 423/213.5 |
| 4,189,405 | 2/1980 | Knapton et al. | 423/213.5 |
| 4,299,086 | 11/1981 | Madgavkar et al. | 60/723 |

OTHER PUBLICATIONS

Tantalum and Niobium (ed) Miller Academic Press, N.Y. 1959, pp. 621, 627.

Binary Alloy Phase Diagrams, vol. 2, eds. Massalski et al, ASM, 1986, p. 1988.

"Development Potential of Advanced Intermetallic Materials" Interim Technical Report No. 12 Contract No. F33615-86-C-5055 R. L. Fleischer.

"Development Potential of Advanced Intermetallic Materials" Interim Technical Report No. 11 Contract No. F33615-86-C-5055, R. L. Fleischer.

"Development Potential of Advanced Intermetallic Compounds" Interim Technical Report No. 9 Contract No. F33615-86-C-5055, R. L. Fleischer.

"Development Potential of Advanced Intermetallic Materials" Interim Technical Report No. 8 Contract No. F33615-86-C-5055, R. L. Fleischer.

*Primary Examiner*—Upendra Roy

*Attorney, Agent, or Firm*—James E. McGinness; James C. Davis, Jr.; James Magee, Jr.

[57] ABSTRACT

Intermetallic compounds of ruthenium and tantalum are disclosed comprising about 46 to 53 atomic percent tantalum and the balance substantially ruthenium. Another intermetallic compound is comprised of, about 45 to 54 atomic percent tantalum, up to about 35 atomic percent cobalt, and the balance substantially ruthenium, with ruthenium plus cobalt being less than 55 atomic percent. Another intermetallic compound is comprised of, about 45 to 54 atomic percent tantalum, up to about 25 atomic percent iron, and the balance substantially ruthenium. The intermetallic compounds have a high hardness up to about 950° C. and have good room-temperature toughness.

7 Claims, No Drawings

RUTHENIUM TANTALUM INTERMETALLIC COMPOUNDS CONTAINING IRON OR COBALT

The U.S. government has rights in this invention pursuant to Contract No. F33615-86-C-5055 awarded by the U.S. Air Force.

This invention is related to copending application Ser. No. 07/457,009, filed Dec. 26, 1989.

BACKGROUND OF THE INVENTION

This invention relates to high-temperature alloys, and more particularly to intermetallic compounds comprising ruthenium and tantalum having high hardness at elevated temperatures and good room-temperature toughness.

Intermetallic compounds are alloys having a simple stoichiometric proportion between the components and having a crystal structure different from the crystal structure of the component elements. The structure of intermetallic compounds is homogeneous over a typically narrow composition range where atoms of each component occupy ordered sites in the crystal lattice. Many intermetallic compounds have been studied because of their potential for use at elevated temperatures. The compounds can have greater stiffness than the metals from which they are formed, and have higher strength at elevated temperatures as compared to disordered alloys. In many cases low specific gravities give intermetallic compounds a high ratio of stiffness-to-density and strength-to-density, two quantities that are highly desirable in aircraft or rotating parts.

A serious problem in the use of intermetallic compounds comes from their tendency toward brittleness. Brittleness in intermetallic compounds is shown by poor ductility or poor toughness at low-temperatures such as room-temperature. Toughness is the ability of a material to absorb impact energy. A result of such brittleness is that many intermetallic compounds cannot be formed extensively and the articles that can be formed are susceptible to damage in their normal use and handling.

A well known intermetallic compound system is the titanium aluminides. Many of the advances from the research of titanium aluminides produced alloys having a reduced tendency toward brittleness while maintaining a high strength at elevated temperatures. For example in U.S. Pat. No. 4,292,077 to Blackburn et al., trititanium aluminides consisting of about 24–27 atomic percent aluminum, 11–16 atomic percent niobium, and the balance titanium are disclosed as having good high-temperature strength with low-temperature ductility. The Blackburn alloys are disclosed as being useful at temperatures of about 600° C.

It is well known within the metallurgical art that indentation hardness is an indicator of the yield strength of materials, "The Indentation of Materials by Wedges," Hirst, W., Howse, M.G.J.W., Proceedings of the Royal Society A., Vol 311, pp. 429–444 (1969). Therefore a comparative determination of the high-temperature strength of different materials can be made from comparing the high-temperature indentation hardness of the materials.

An object of this invention is to provide intermetallic compounds having good high-temperature hardness, and therefore high strength, at temperatures up to about 1150° C., and good toughness at room-temperature.

BRIEF DESCRIPTION OF THE INVENTION

I have discovered intermetallic compounds of ruthenium and tantalum having good high-temperature hardness, and good room-temperature toughness comprising, about 46 to 53 atomic percent tantalum and the balance substantially ruthenium. Such ruthenium-tantalum intermetallic compounds are herein referred to as RuTa compounds. A more preferred range comprises about 49 to 53 atomic percent tantalum, and the balance ruthenium.

Intermetallic compounds of ruthenium, tantalum, and cobalt having good high-temperature hardness, and good room-temperature toughness are comprised of; about 44 to 54 atomic percent tantalum, up to about 35 atomic percent cobalt, and the balance substantially ruthenium. A more preferred range comprises, about 45 to 54 atomic percent tantalum, up to about 35 atomic percent cobalt, and the balance substantially ruthenium, with tantalum plus cobalt being at least 57 atomic percent.

Intermetallic compounds of ruthenium, tantalum, and iron having good high-temperature hardness, and good room-temperature toughness are comprised of; about 44 to 54 atomic percent tantalum, up to about 30 atomic percent iron, and the balance substantially ruthenium. A more preferred range comprises, about 45 to 54 atomic percent tantalum, about 7 to 15 atomic percent iron, and the balance substantially ruthenium. Intermetallic compounds comprised of ruthenium, tantalum, and cobalt or iron are sometimes herein referred to as "RuTa compounds."

As used herein, the term "balance substantially ruthenium," means that the ruthenium comprises the remaining atomic percentage, however, other elements which do not interfere with achievement of the high hardness at temperatures up to 1150° C. and good room-temperature toughness of the intermetallic compounds may be present either as impurities or up to non-interfering levels.

The term "good high-temperature hardness" means the Vickers hardness is at least comparable to the hardness of Ti-24A1-11Nb at elevated temperatures up to at least 950° C.

The term "good room-temperature toughness," means the room-temperature toughness is at least comparable to the room-temperature toughness of Ti-24A1-11Nb.

DETAILED DESCRIPTION OF THE INVENTION

RuTa compounds disclosed herein can be prepared by the well-known processes used for other alloys having high melting temperatures. For example, RuTa compounds can be prepared by arc-melting or induction melting in a copper crucible under a protective atmosphere. RuTa compounds can also be prepared by powder metallurgy techniques, such as admixing finely comminuted alloying ingredients followed by consolidation through the application of heat and pressure.

Shaped structural articles can be produced by casting the RuTa compounds from the molten state. Optionally the casting is hot-isostatically pressed to reduce porosity. Molten RuTa compounds can also be rapidly solidified into foils, and the foils consolidated through the application of heat and pressure. Admixed powders of the RuTa compounds can be shaped into articles by pressing and consolidating the pressed article through the application of heat and pressure.

RuTa compounds disclosed herein have a microstructure predominately of the $L1_0$ type which is a tetragonal structure. One minor phase identified in some RuTa compounds is the B2 phase, also known as the cesium chloride structure. Some RuTa compounds contain unidentified minor phases. The volume fraction of the L10 structure is at least about 60 percent in the RuTa compounds of this invention.

The following Example shows the good hardness at high-temperature, and good toughness at room-temperature of the RuTa compounds disclosed herein.

EXAMPLE

Samples of RuTa compounds were prepared by melting high purity ruthenium and tantalum according to the compositions shown below in Table I. The compositions for test nos. 1–4, 6–9, 15, 17, and 19–21 were measured by X-ray fluorescence, and the remaining compositions shown in Table I were the aim compositions for melting. In some samples cobalt or iron was added to the intermetallic compound as shown in Table I. Samples were prepared by arc-melting, casting in chilled copper molds, and heat treating at 1350° C. for 20 hours in argon filled silicon dioxide ampules that included a small piece of yttrium to getter oxygen. The castings were cut and polished into 1.0×0.5×0.5 cm bar samples for hardness testing.

Vickers hardness of the samples was measured at room-temperature and at elevated temperatures on a Nikon-GM tester, using a diamond or sapphire pyramid indenter and a load of 1,000 grams in conformance with ASTM E 92, "Standard Test Method for Vickers Hardness of Metallic Materials," Annual Book of ASTM Standards, Vol. 3.01, 1989. The testing was performed in a vacuum of about $10^{-8}$ atmospheres, or slightly less at the highest temperatures where some outgassing or vaporization of the sample may occur.

A simple measure of room-temperature toughness was performed on the as-cast and annealed samples by a chisel impact test. A steel chisel and a hammer of either 160 grams or 729 grams was used in the impact test. The steel chisel was placed against the sample and struck sharply with one of the hammers. Ratings were developed for the test as follows; 0 is a sample that broke upon cooling after casting or after a light tap of the 160-gram hammer, a 1 rating required repeated sharp blows with the 160-gram hammer to fracture the sample, a 2 rating required repeated sharp blows with the 729-gram hammer to fracture the sample, and samples were given a 3 rating when repeated sharp blows with the 729-gram hammer did not cause fracture of the sample. This test is not a standardized test but gives a relative rating of toughness when samples are tested in the same manner.

The volume fraction of $L1_0$ phase was determined by metallographic inspection of polished samples. The results of the above described tests performed on the RuTa compounds prepared in this Example are shown below in Table I.

TABLE I

Mechanical Properties of RuTa Compounds

| Test No. | Composition (Atomic Percent) Ru | Ta | Co | Fe | Average Vickers Hardness (kg/mm²) Room Temp. | 950° C. | 1150° C. | Room Temp. Chisel Impact Rating |
|---|---|---|---|---|---|---|---|---|
| 1 | 47 | 53 | | | 977 | 238 | 184 | 2 |
| 2 | 51 | 49 | | | 882 | 229 | 168 | 2 |
| 3 | 52 | 48 | | | 831 | 218 | 105 | 2 |
| 4 | 55 | 45 | | | 950 | 339 | 195 | 0 |
| 5 | 41 | 53 | 6 | | 804 | 222 | 138 | 2 |
| 6 | 45 | 45 | 10 | | 944 | 418 | 182 | 1 |
| 7 | 36 | 50 | 14 | | 716 | 185 | 61 | 3 |
| 8 | 32 | 50 | 18 | | 643 | 138 | 40 | 3 |
| 9 | 31 | 44 | 25 | | 1061 | 386 | 140 | 2 |
| 10 | 24 | 50 | 26 | | | | | 3 |
| 11 | 20 | 50 | 30 | | 833 | 136 | 20 | 3 |
| 12 | 37 | 60 | | 3 | | | | 1 |
| 13 | 35 | 60 | | 5 | | | | 1 |
| 14 | 42.5 | 54 | | 3.5 | | | | 2 |
| 15 | 42.8 | 49.5 | | 7.7 | 701 | 257 | 137 | 3 |
| 16 | 40 | 52 | | 8 | 785 | 201 | 72 | 3 |
| 17 | 46 | 44 | | 10 | 720 | 294 | 169 | 2 |
| 18 | 35 | 51 | | 14 | 756 | 142 | 38 | 3 |
| 19 | 43 | 41 | | 15 | 889 | 361 | 112 | 2 |
| 20 | 26 | 49 | | 25 | 796 | 288 | 198 | 2 |
| 21 | 30 | 44 | | 26 | 744 | 427 | 187 | 2 |
| 22 | 32.5 | 41.5 | | 26 | | | | 1 |

Table II below contains the Vickers hardness and chisel impact rating from samples of a trititanium aluminide within the composition of the '077 patent discussed above. The trititanium aluminide samples were prepared according to processes well known in the industry to provide optimum properties for Ti-24Al-11Nb alloys.

TABLE II

MECHANICAL PROPERTIES FOR TRITITANIUM ALUMINIDE INTERMETALLIC COMPOUND OF ABOUT Ti—24Al—11Nb

| Average Vickers Hardness (kg/mm²) Room Temp. | 815° C. | Room-Temperature Chisel Impact Rating |
|---|---|---|
| 316 | 173 | 2 |

First the properties of the RuTa compounds shown in Table I are compared. The binary RuTa compound containing 45 atomic percent tantalum had a high hardness at room and elevated temperatures but the toughness was poor. See test no. 4 having 45 atomic percent tantalum and a chisel impact rating of 0. However, when tantalum is greater than 45 atomic percent in binary RuTa compounds a high hardness is maintained at room and elevated temperatures up to 1150° C. with good toughness. For example see test nos. 1,2, and 3 having from 48 to 53 atomic percent tantalum and chisel impact ratings of 2.

RuTa compounds containing cobalt up to about 30 atomic percent or iron up to about 26 atomic percent were found to have a high hardness at elevated temperatures with good or excellent toughness. However, when tantalum was at a high level of 60 atomic percent as in tests 12 and 13 toughness was poor. Test no. 22 had a low tantalum content of 41.5 atomic percent and toughness was found to be poor. Therefore, an intermediate tantalum content of about 44 to 54 atomic percent is desirable for RuTa compounds containing cobalt or iron additions.

Test number 6 containing 45 atomic percent tantalum and 10 atomic percent cobalt had the lowest combined amount of tantalum and cobalt and had poor toughness. Therefore tantalum plus cobalt is preferably at least 57 atomic percent in RuTa compounds containing cobalt.

As discussed above, the trititanium aluminide Ti-24A1-11Nb is a material having high strength at elevated temperatures up to about 600° C. with good low-temperature ductility. Since yield strength has been shown to be related to indentation hardness it follows that Ti-24A1-11Nb is a material having good high-temperature hardness. The Vickers hardness and chisel impact ratings from the samples prepared from the RuTa compounds in Table I are next compared to the trititanium aluminide samples in Table II.

As compared to Ti-24A1-11Nb, the RuTa compounds of this invention have a comparable or higher hardness at low-temperatures and elevated temperatures. In fact most RuTa compounds have a higher hardness at 950° C. than the hardness at 815° C. of Ti-24A1-11Nb. Similarly, the room-temperature toughness is comparable or superior in the RuTa compounds of this invention as compared to Ti-24A1-11Nb. Again, since indentation hardness is related to yield strength and the hardness of the RuTa compounds disclosed herein is comparable or superior to Ti-24A1-11Nb it follows that the RuTa compounds of this invention have good high-temperature strength up to at least 950° C. In addition, test nos. 1–3, 5, 9, 15, 17, and 19–21 have shown high hardness, and therefore strength, up to 1150° C. as well as good room-temperature toughness.

Contemplated uses for the RuTa compounds disclosed herein include elevated temperature applications such as jet engine components. For example contemplated uses include; compressor wheels or blades, turbine wheels or blades, or more generally for applications requiring lightness in weight and retention of strength at elevated temperatures such as plates, channels, or equivalent structural components, tubes, engine housings, or shrouds.

We claim:

1. An intermetallic compound of ruthenium and tantalum comprising: about 44 to 54 atomic percent tantalum, an element from the group consisting of about 2 to 30 atomic percent iron and about 5 to 35 atomic percent cobalt, and the balance substantially ruthenium, the intermetallic compound having good high-temperature hardness, and good room-temperature toughness.

2. The intermetallic compound of claim 1 wherein tantalum is about 45 to 54 atomic percent, and tantalum plus cobalt is at least 57 atomic percent.

3. The alloy of claim 1 comprising about 7 to 15 atomic percent iron.

4. A structural member having good high-temperature hardness, and good room-temperature toughness comprising, an intermetallic compound of about 44 to 54 atomic percent tantalum, about 5 to 35 atomic percent cobalt, and the balance substantially ruthenium.

5. The structural member of claim 4 wherein tantalum is about 45 to 54 atomic percent, and tantalum plus cobalt is at least 57 atomic percent.

6. A structural member having good high-temperature hardness, and good room-temperature toughness comprising, an intermetallic compound of about 44 to 54 atomic percent tantalum, about 2 to 30 atomic percent iron, and the balance substantially ruthenium.

7. The structural member of claim 6 comprised of about 7 to 15 atomic percent iron.

* * * * *